US006543106B1

(12) United States Patent
Ames et al.

(10) Patent No.: US 6,543,106 B1
(45) Date of Patent: Apr. 8, 2003

(54) APPARATUS, METHOD AND SYSTEM FOR AIR OPENING OF TEXTILE TOW AND OPENED TEXTILE TOW WEB PRODUCED THEREBY

(75) Inventors: Todd Ames, York, SC (US); Ricky Lee Kenley, Charlotte, NC (US); Edward J. Powers, Charlotte, NC (US); William West, Charlotte, NC (US); William T. Wygand, Charlotte, NC (US); Jean-Claude Abed, Simpsonville, SC (US); Bobby R. Lomax, Fort Mill, SC (US)

(73) Assignee: Celanese Acetate, LLC, Charlotte, NC (US)

( * ) Notice: Subject to any disclaimer, the term of this patent is extended or adjusted under 35 U.S.C. 154(b) by 196 days.

(21) Appl. No.: 09/679,681

(22) Filed: Oct. 5, 2000

Related U.S. Application Data

(63) Continuation-in-part of application No. 09/426,268, filed on Oct. 25, 1999, now Pat. No. 6,253,431.

(51) Int. Cl.[7] ..... D01D 11/02; D02J 1/18

(52) U.S. Cl. ..... 28/283; 28/271; 28/221; 28/267; 19/66 T

(58) Field of Search ..... 28/283, 282, 281, 28/220, 221, 262, 263, 264, 265, 267, 271, 273, 274, 276, 248; 19/66 T, 66 R; 493/44, 50, 48; 428/370, 364, 373, 374

(56) References Cited

U.S. PATENT DOCUMENTS

| | | | |
|---|---|---|---|
| 2,794,480 | A | 6/1957 | Crawford |
| 2,908,045 | A | 10/1959 | Stevens |
| 3,017,309 | A | 1/1962 | Crawford et al. |
| 3,032,829 | A | 5/1962 | Mahoney |
| 3,050,430 | A | 8/1962 | Gallagher |
| 3,079,663 | A | 3/1963 | Dyer |
| 3,081,951 | A | 3/1963 | Dyer et al. |
| 3,095,343 | A | 6/1963 | Berger |
| 3,099,594 | A | 7/1963 | Caines |
| 3,156,016 | A | 11/1964 | Dunlap et al. |
| 3,226,773 | A | 1/1966 | Paliyenko |
| 3,258,823 | A | 7/1966 | Stevens et al. |
| 3,262,178 | A | 7/1966 | Aspy |
| 3,262,181 | A | 7/1966 | Hawkins |
| 3,281,913 | A | 11/1966 | Morehead |
| 3,282,768 | A | 11/1966 | Caines |

(List continued on next page.)

FOREIGN PATENT DOCUMENTS

| | | |
|---|---|---|
| EP | 0 357 257 | 7/1990 |
| JP | 7-496111 | 3/1984 |
| WO | WO 83/03267 | 9/1983 |
| WO | WO 99/30661 | 6/1999 |

OTHER PUBLICATIONS

European Search Report.

*Primary Examiner*—Amy B. Vanatta
(74) *Attorney, Agent, or Firm*—Kennedy Covington Lobdell & Hickman, LLP

(57) ABSTRACT

The invention provides an air opening jet for use in a process for making a rectangular structure made from a tow of fibers, such air opening jet including a housing, an air jet for moving the tow through the housing and opening the tow, and an accumulating chamber that includes at least one, and preferably two, perforated plates located in the path of the moving tow, and an air control arrangement for controlling the flow of air so that the moving tow is urged into engagement with the perforated plates to retard movement of the tow and cause it to properly accumulate in the accumulation chamber. The invention also includes methods for using the air opening jet apparatus to produce multi-tow band products, and products produced by such methods.

32 Claims, 13 Drawing Sheets

U.S. PATENT DOCUMENTS 3,297,506 A 1/1967 Pannill
3,384,932 A * 5/1968 Watson, Jr. ..... 19/65 T
3,402,446 A 9/1968 Benson
3,413,698 A 12/1968 Fritz et al.
3,501,811 A 3/1970 Watson ..... 19/65
3,505,155 A 4/1970 Balch et al. ..... 161/57
3,523,059 A 8/1970 Coates
3,525,134 A 8/1970 Coon
3,535,745 A * 10/1970 Ziedman ..... 28/283
3,645,431 A 2/1972 Harrison
3,664,115 A 5/1972 Watson ..... 57/156
3,730,824 A * 5/1973 Watson ..... 28/283
3,745,617 A 7/1973 Smith, Jr.
3,766,606 A * 10/1973 Piper et al. ..... 28/283
3,795,944 A 3/1974 Daniels ..... 19/65
3,805,343 A 4/1974 Ethridge
3,831,501 A 8/1974 Bevington, Jr.
3,960,645 A 6/1976 Brackmann et al.
4,259,769 A * 4/1981 Greve et al. ..... 28/283
4,268,940 A 5/1981 Kuroda et al. ..... 28/255
4,289,130 A 9/1981 Usami et al.
4,435,239 A 3/1984 Harris
4,468,845 A 9/1984 Harris
4,472,224 A 9/1984 Pryor
4,522,616 A 6/1985 Hyde
4,541,825 A 9/1985 Hyde et al.
4,799,985 A * 1/1989 McMahon et al. ..... 28/283
4,818,318 A * 4/1989 McMahon et al. ..... 28/283
4,949,441 A 8/1990 Ethridge ..... 28/271
5,008,992 A * 4/1991 Gehrmann et al. ..... 28/252
5,060,351 A 10/1991 Street
5,171,235 A 12/1992 Theis et al.
5,177,840 A * 1/1993 Laws ..... 28/220
5,203,757 A 4/1993 Kampen
5,282,779 A * 2/1994 Sakai et al. ..... 28/276
5,331,976 A 7/1994 St. Pierre
5,355,567 A * 10/1994 Holliday ..... 28/282
H1565 H 7/1996 Brodof et al.
5,579,566 A 12/1996 Burkhardt
5,591,297 A 1/1997 Ahr
5,928,452 A 7/1999 McFall et al.
6,032,342 A * 3/2000 Kawabe et al. ..... 28/283

* cited by examiner

Fig. 19

Tow Composite with SAP:

| Sample # | SAP Type | SAP BW (Target) | Tow #1 Dpf | Tow #1 Total Denier (x1000) | Tow #2 Dpf | Tow #2 Total Denier (x1000) | Overall Total Denier | Avg. Tow Dpf | Total # Of Fils | Calc. Tow BW | Calc. SAP BW |
|---|---|---|---|---|---|---|---|---|---|---|---|
| 2-0601 | SA-55SX | 250 | 2.6 | 42 | | | 42 | 2.6 | 16200 | 55 | 245 |
| 3-0601 | SA-55SX | 250 | 4.0 | 48 | | | 48 | 4.0 | 12000 | 52 | 255 |
| 4-0601 | SA-55SX | 250 | 5.0 | 39 | | | 39 | 5.0 | 7800 | 54 | 238 |
| 6-0601 | SA-55SX | 250 | 2.7 | 32 | 6.0 | 15 | 47 | 3.8 | 11900 | 68 | 252 |
| 7-0601 | SA-55SX | 250 | 1.7 | 22 | 6.0 | 15 | 37 | 3.4 | 13000 | 53 | 245 |

Fig. 20

Sample performance results:

| Sample | Acquisition as a F(Strikethrough) | | | Absorption as a F(Rewet) | | |
|---|---|---|---|---|---|---|
| | Insult 1 | Insult 2 | Insult 3 | Insult 1 | Insult 2 | Insult 3 |
| 6-0601 Vs 2-0601 | 30% Faster | 20% Faster | 22% Faster | 50% Less | 24% Less | 5% Less |
| 6-0601 Vs 3-0601 | 20% Faster | 13% Faster | 9% Faster | 44% Less | 22% Less | 12% Less |
| 6-0601 Vs 4-0601 | 20% Faster | 150% Faster | 10% Faster | 50% Less | 10% Less | 10% More |

APPARATUS, METHOD AND SYSTEM FOR AIR OPENING OF TEXTILE TOW AND OPENED TEXTILE TOW WEB PRODUCED THEREBY

This application is a continuation-in-part application of U.S. patent application Ser. No. 09/426,268, filed Oct. 25, 1999 now U.S. Pat No. 6,253,431.

FIELD OF THE INVENTION

This invention relates to systems which can be used to open a tow of fibers such that the resulting "opened tow" of fibers has a shape useful in the production of absorbent structures, and more particularly to an air opening jet apparatus and method for use in such systems and products formed by such systems.

BACKGROUND OF THE INVENTION

Many types of filaments, fibers and yarn (collectively "fibers") are sold as a "tow" in which a plurality of such fibers are compressed together, optionally with crimping, by methods known to those skilled in the art in order to maximize the content of the packing systems, for example, bales, by which such tows are sold and delivered to users of tow. Before use, such users generally "open" such tow, separating the compressed fibers by a distance greater than that in the compressed state. Numerous methods and devices for opening tows are known and described in the art. Examples include U.S. Pat. Nos. 3,282,768, 3,523,059, 3,099,594, 4,522,616, 2,794,480, 3,032,829, 5,591,297 and 5,203,757 whose teachings are incorporated herein by reference. While such devices have found utility in various applications, such devices typically produce "opened" tows which were substantially circular in cross-section, for example, tows used to make smoke filters or writing instrument reservoirs. However, for other applications a rectangular shape is preferred; for example, absorbent structures which are intended for use in personal care products such as diapers, bandages, hygiene pads and similar absorbent products. For such uses a shape that has a substantially rectangular cross-section is preferred. A representative sampling of these various types of products are disclosed in U.S. Pat. Nos. 4,289,130, 5,171,235, and 5,928,452, U.S. Statutory Invention Registration No. H1565, and PCT International Publication No. WO 99/30661.

It is also known to use, in systems of the foregoing types, air jets which open the tow and form it into a rectangular shape for use in tobacco filter rods and the like, as disclosed in U.S. Pat. Nos. 4,468,845 and 4,435,239. One of the significant advantages asserted for these systems is the fact that the air opening jet employed in the system is designed to operate at very low air pressures (e.g. less than 3 psi), which is said to eliminate the need for the large capital investment in expensive air compressing and piping facilities normally associated with air opening or "blooming" systems. This low pressure air is utilized to move the tow through the air opening jet, during which the tow is opened, and then through a bustle assembly in which the opened tow is decelerated and retarded in the bustle assembly to obtain the desired opening and density of the tow. This deceleration and retarding of the tow is obtained by an adjustable tension arrangement for engaging the tow, and more particularly by a flat, imperforate "tension" plate that is pivotally mounted at one of its ends within the bustle assembly, and a relatively complex mechanical arrangement for adjusting the movement of the pivoted tension plate toward and away from the tow to thereby vary the tension force applied to the tow by the tension plate.

SUMMARY OF THE INVENTION

In accordance with one aspect of the present invention, an air opening jet apparatus is provided for use in a system for opening a thin, relatively wide tow of textile filaments held together by crimping and forming the opened tow into a predetermined shape suitable for use, for example, as an absorbent structure for personal care products. The air opening jet apparatus includes a housing having an inlet opening for receiving a partially opened tow and having a configuration corresponding generally to the shape of the partially opened tow. The housing also has an outlet opening through which the tow exits the housing and this outlet opening has a configuration corresponding generally to the predetermined shape.

An air jet is formed within the housing adjacent the inlet opening thereof to create a venturi which moves the tow through the air opening jet apparatus and which also further opens the tow, and a source of compressed air communicates with the air jet to provide carrier air for moving the tow through the air opening jet apparatus.

A forming chamber is provided within the housing and downstream of the air jet that includes a gradually increasing cross-sectional area in the direction of flow of the tow that corresponds to the predetermined shape, the air jet being disposed within the housing to cause the tow to be fully opened and to substantially fill the forming chamber as it moves therethrough.

An accumulating chamber is located within the housing downstream of the forming chamber that is constructed and arranged to permit the opened tow to accumulate within the accumulating chamber and be withdrawn from the housing at different flow rates through the housing outlet opening in the predetermined shape. The accumulating chamber includes at least one perforated plate disposed in the path of the tow and the carrier air moving therethrough to cause the tow to engage the perforated plate and to cause at least some of the carrier air to pass through the perforated plate.

A control valve is provided for maintaining the flow of the carrier air at a level that will cause at least the portion of the carrier air to pass through the perforated plate and urge the tow into frictional engagement with the perforated plate with sufficient force to retard the movement of the tow through the accumulating chamber and cause the tow to accumulate in the accumulating chamber.

In the preferred embodiment of the present invention, the accumulating chamber may include a second perforated plate located in spaced relation to the first above mentioned perforated plate, and the tow moves between the perforated plates and is urged into engagement therewith by the carrier air passing through both the perforated plates. Finally, in the preferred embodiment of the present invention, the predetermined shape of the outlet opening in the housing is rectangular.

Another aspect of the present invention provides an apparatus and method by which one or more air opening jets of the aforesaid type may be utilized for opening and forming multiple tows into a composite multi-tow band of a predetermined shape suitable for use, for example, as an absorbent structure for personal care products. In this type of system, instead of a single tow being delivered to the inlet end of an air opening jet apparatus, two separate and distinct tows are delivered to the inlet end of a single air opening jet or to separate air opening jets and are combined therein or downstream therefrom into a composite multi-tow band.

In this system, a first arrangement is provided for receiving a first tow from a tow bale having a predetermined denier units per filament, spreading the filaments in the first tow into a first tow band, and having an exit end for discharging the first tow band therefrom with a predetermined width. A second arrangement is provided for receiving a second tow from a second tow bale having a predetermined denier units per filament which is different from the predetermined denier of the first tow, spreading the filaments in the second tow into a second tow band, and having an exit end for discharging the second tow band therefrom with a predetermined width. The first and second tow bands are then simultaneously introduced into the inlet end of the air opening jet apparatus and moved therethrough for opening and forming as described above in connection with a single tow. The first and second tow bands can also be introduced to two separate air opening jet apparatuses.

Each of said first and second arrangements may preferably comprise a tow banding jet for receiving the respective first or second tow and spreading the tow into the form of a band, and at least one pair, and preferably multiple pairs, of delivery rolls disposed between the first and second banding jets, respectively, and the air opening jet apparatus or apparatuses.

In one contemplated embodiment of this system, the width of the exit end of one of the first or second banding arrangements is smaller than the other, whereby the multi-tow band discharged from the exit end of the air jet opening apparatus or apparatuses has one tow band that is larger in width than the other. It is preferred that the tow band having the larger width have a denier per filament that is less than the denier per filament of the other tow band. Additionally, the system may include a surfactant applicator located upstream of the inlet of the air opening jet for applying a surfactant to the tow band having a smaller width, and the system may include a bonding agent applicator located upstream of the inlet of the air opening jet for applying a bonding agent to the tow band having a larger width. It is also possible to individually vary the delivery speed of the two tow bands to the inlet of the air opening jet apparatus, and to individually control the bloom of the two tow bands.

BRIEF DESCRIPTION OF THE DRAWINGS

FIG. 19 is a table compiling comparative physical data of sample single-tow web products formed by the system illustrated in FIG. 1 with the sample composite multi-tow web products formed by the system of FIG. 8; and FIG. 20 is a table compiling the results of comparative performance tests of the sample web products of FIG. 19.

DETAILED DESCRIPTION OF THE INVENTION

Figure 1:
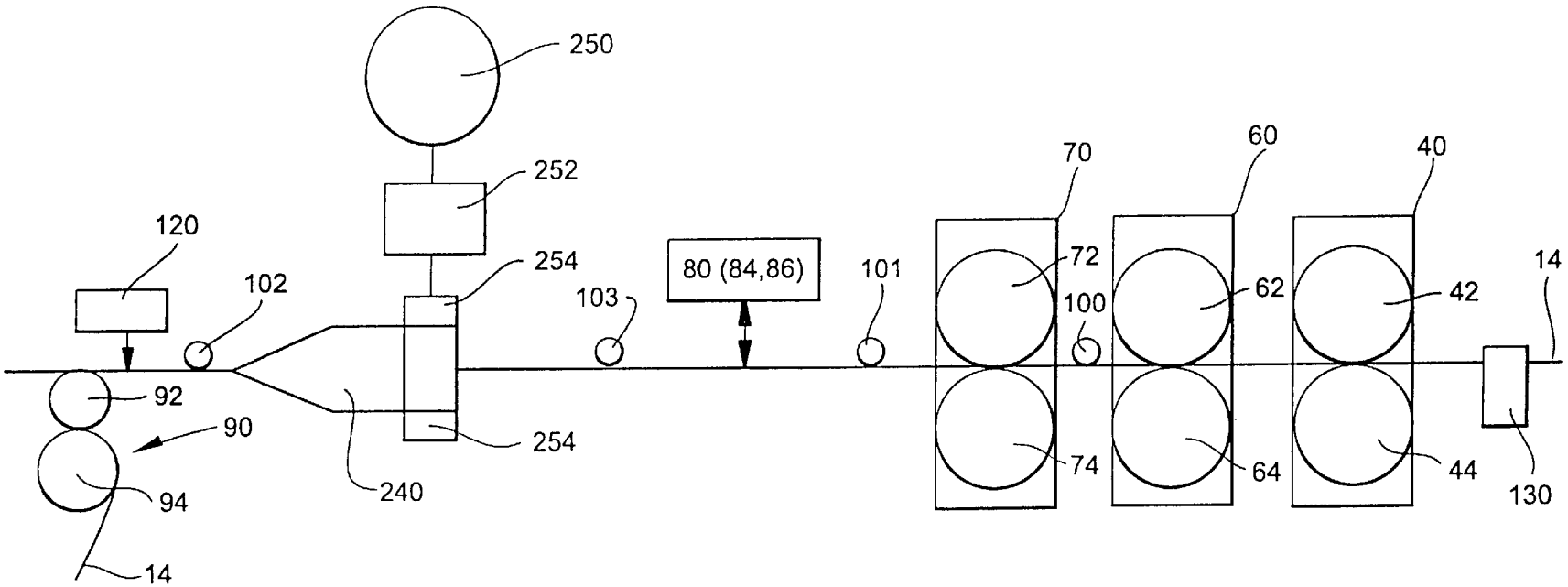
FIG. 1 is a diagrammatic illustration of a typical tow opening system of the type in which the air opening jet of the present invention may be used.
Figure 2:
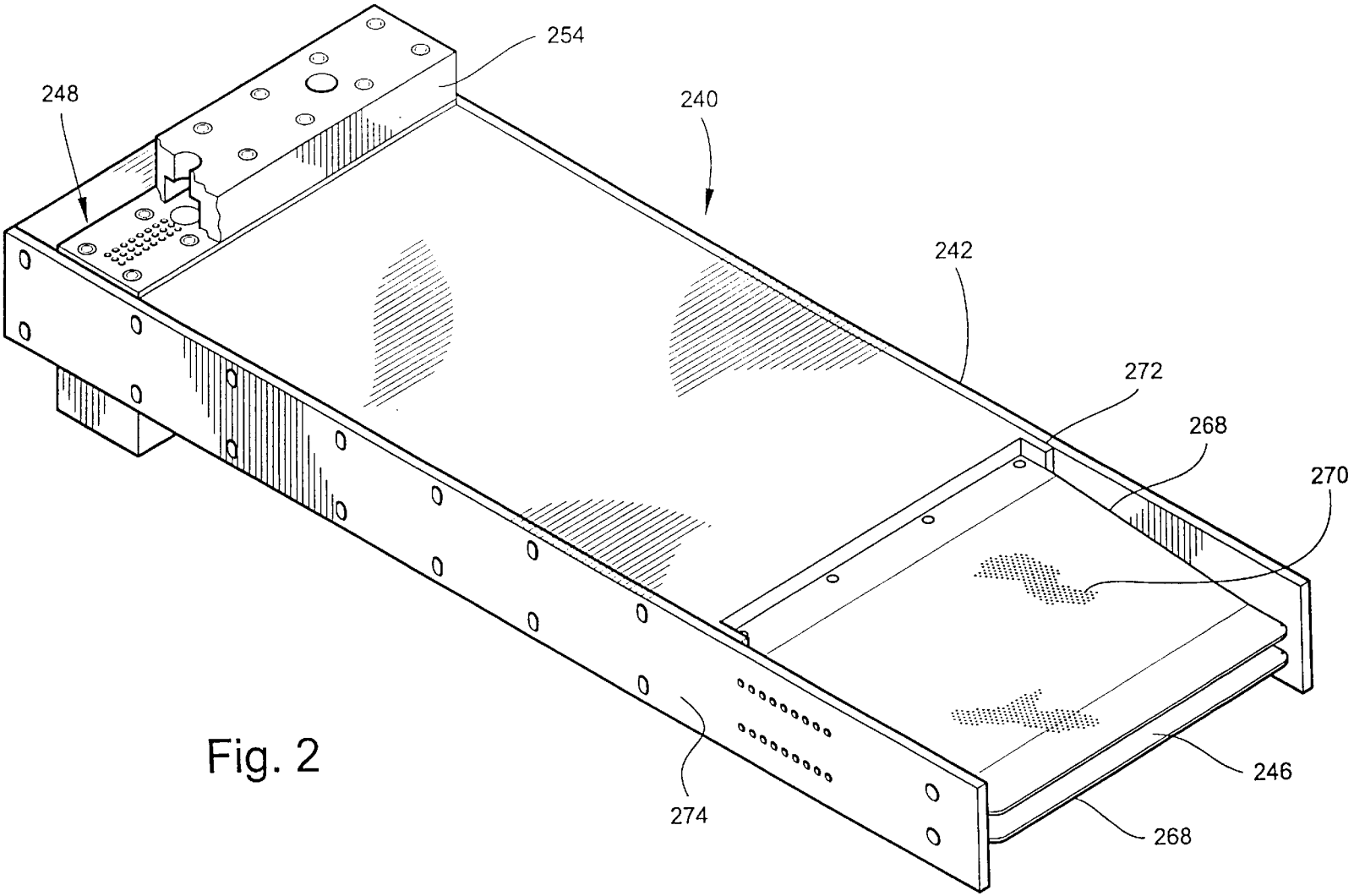
FIG. 2 is a perspective view of a preferred embodiment of the air opening jet of the present invention.

The term "fiber" as used herein means a filament, fiber or yarn of any material whatsoever; for example, cellulose acetate and triacetate, polyester, polyamide, polyolefin and similar polymeric substances.

The term "tow" as used herein means a plurality of fibers compressed together, optionally with "crimping" as such term is used and understood in art, by methods known to those skilled in the art in order to maximize the content of packaging systems by which such tows are sold and delivered, or to facilitate the transport of such plurality of fibers from one point to another point, for example, within a manufacturing facility.

The terms "rectangular" and "substantially rectangular" as used herein, are to be understood as meaning a structure have a generally rectangular cross-section with possible slight defects, for example, rounded corners and a slight bowing or indentation along a side.

The fibers comprising the tow may be made from any natural or synthetic substance, or mixture and/or blends thereof, including polyesters, polyamides, cellulose acetate and triacetate (collectively, an "acetate" tow), polypropylene oxide, polyethylene sulfide, liquid crystalline polymeric substances capable of being formed into fibers, polyamides, silk, wool, cotton, rayon, polyolefins, polyacrylates, polymethacrylates, and similar substances which can be made into fibers. Such fibers may or may not have a "finish" applied to them, depending upon their application. Generally, an external finish is applied to such fibers so as to facilitate transport, although "internal" finishes, contained in the material used to form the fiber, may also be used and such fibers are included within the scope of the invention. In addition, the fibers of the tow may be of any denier, tex, diameter or other cross-sectional or cross-section related size designation suitable for producing tow.

The terms "banding jet" and "air banding jet" are used to signify a first tow opening device which utilizes air to spread a tow in a direction perpendicular to the direction of travel. The "banding jet" is different and distinct from the "opening jet" or "air opening jet" also described herein.

While the present invention may have a wide variety of tow opening applications, it has been found to be particularly useful in opening a tow made of acetate fibers, polyester fibers, polyolefin fibers and polyamide fibers, and mixtures thereof. For example, an acetate tow may consist of about 2,500 to about 25,000 fibers having an individual denier of from about 1 to about 10, preferably of from about 3 to about 6. The total denier for the entire tow, that is the assemblage of from about 2,500 to about 25,000 fibers, is thus from about 2,500 to about 250,000. Acetate tows are generally of about 10,000 to about 20,000 fibers of individual denier of about 3 to about 6, giving rise to a tow having a total denier of about 30,000 to about 120,000.

The fibers of a tow should be uniformly or substantially uniformly distributed across the width/cross-section of the crimped tow bundle or band. This uniform fiber distribution is important to the process of opening a tow into a rectangular or substantially rectangular shape, and the more nearly uniform distribution of fibers the easier it will be to produce a rectangular or substantially rectangular opened tow. Crimped and baled tows having a variety of width/cross-sections may be used in accordance with the invention, for example, about 25 mm (millimeters) to about 75 mm in width, preferably from about 40 mm to about 60 mm, and from about 1 mm to about 7 mm in height or thickness, preferably from about 2 mm to about 5 mm, with typical the dimensions being about 50 mm wide and about 3 mm thick.

As previously mentioned, an external finish may be applied to each fiber in a tow, such finish being in an amount from about 0.3% to about 5% by weight of the fiber bundle, preferably from about 0.5% to about 2.0%.

The tows used in practicing the invention are generally "crimped tows" as the term is used and known to those skilled in the art. Crimping is done at about 5 to about 30 crimps per inch of uncrimped tow, preferably of from about 20 to about 25 crimps per inch of uncrimped tow.

While it is to be understood that the present invention may have applications in a variety of tow opening systems, one typical system in which the present invention finds particular application is illustrated diagrammatically in FIG. 1. A tow 14 may initially be fed through a conventional set of guides (not shown) to flatten and orient the tow 14. The tow is then fed to a banding jet 130 of conventional design. The banding jet evenly spreads the tow band in the direction perpendicular to the tow processing direction. Generally, the air banding jet 130 used in these preferred embodiments can be any air banding jet known in the art, for example, as described in U.S. Pat. No. 3,226,773, or in co-pending U.S. patent application Ser. No. 09/219,818, filed Dec. 23, 1998, whose teachings are incorporated herein by reference. The tow 14 is then fed to a pre-tension roller assembly 40 and is compressed between metal roller 42 and rubber roller 44 of tension roller assembly 40 so as to stretch the tow and deregister and separate the tow fibers. Within tension roller assembly 40, roller pressure, i.e., the force applied to the tow by the rollers 42 and 44, is from about 1 to about 25 psi, preferably from about 5 to about 15 psi. Within device 40 as illustrated in FIG. 1, the metal roller is element 42 (top roller) and the rubber roller is 44 (bottom roller).

After emerging from assembly 40, the tow is fed to roller assembly 60 comprising a driver metal roller 62 and a rubber roller 64, the metal roller 62 having circular grooves or being threaded or being a flat metal roller. During its traverse from assembly 40 to assembly 60, the tow is stretched, the stretching being accomplished by the drag associated with the nip pressure between rolls 42 and 44. The nip pressure between the rollers of assembly 60 is from about 1 to about 40 psi, preferably from about 20 to about 30 psi.

After emerging from assembly 60, tow 14 is passed by an optional first static eliminating bar 100 to remove any static charge which might be present on tow 14 and which might interfere with subsequent operations necessary in the formation of an absorbent structure.

After emerging from assembly 60, the tow is fed to roller assembly 70 comprising a driven metal roller 72 and a rubber roller 74, said metal roller 72 having circular grooves or being threaded, or being a flat metal roller. During its traverse from assembly 60 to assembly 70, the tow is stretched, the stretching being accomplished by driving the metal roller 72 at a rotational speed faster than driven roll 62. The rotational speed of roll 72 is between 20–60 percent faster than roll 62, preferably 30–50 percent. Each of the roller assemblies 40, 60 & 70, are conventional and well known; they include an arrangement for applying a pressure on one of the rolls in the assembly to urge the two rolls in the assembly into engagement with one another at a predetermined pressure level. These conventional assemblies may apply the pressure pneumatically, hydraulically or electrically, but pneumatic control is preferred. The nip pressure between the rollers of assembly 70 is from about 1 psi to about 40 psi, preferably from about 20 psi to about 30 psi.

The tow emerging from assembly 70 is referred to hereafter as tow 14. The grooves or threads of roller 64 and 74 are of a design or orientation known to those skilled in the art of tow processing or opening. The fibers which emerge from assembly 70 are substantially deregistered or opened, suitable for further opening or forming into a lofty rectangular structure.

Substantial deregistration or blooming means that 90% or more, preferably 95% or more, of the fibers constituting the rectangular structure or rectangular tow are spaced apart by a distance greater than the distance between the fibers when the tow 14 was removed from bale 12.

After emerging from assembly 70, tow 14 is passed by an optional static eliminating bar 101 to remove any static charge which might be present on tow 14 and which might interfere with subsequent operations necessary in the formation of an absorbent structure.

After anti-static treatment, tow 14 is transported to an optional liquid additive assembly 80 which includes a liquid holding tank, a metering pump 84 and liquid dispenser applicators 86 within assembly 80 for dispersing liquids onto tow 14. The liquid dispersal applicators 86 may be spray nozzles, disk applicators, rotating brush applicators, wick contact rolls and similar devices of conventional design known to those skilled in the art. Liquids which can be dispersed onto tow 14 include water; hydrophilic liquids such as alcohols, glycols, dimethyl sulfide, ketones, ethers and similar substances; plasticizers such as Fiberset 100 or Fiberset 200 (Henkel Corporation, Cincinnati, Ohio); surfactants; and solutions containing plasticizers, surfactants and similar substances known to those skilled in the art. The liquid or solutions can be applied to either or both sides of tow 14 as it passes through assembly 86, and additionally can be applied in specific patterns of multiple liquids to create unique effects for transferring or storing liquids in an absorbent composite structure in which the rectangular tow 14 is included.

After emerging from the air opening jet 240, the tow 14 is delivered to optional assembly 120 where solid substances, for example, superabsorbent polymers (SAP), glues, adhesives, fragrances, wood pulp, deodorizers, antimicrobial agents and similar substances can be applied to tow 14 by equipment such as a streamout feeder fabricated by Solids Flow, Inc. of Fort Mill, S.C. For example, in the preparation of diapers containing SAP, the SAP may be delivered as a powder or a slurry vertically downwards onto tow 14. The low density, open, rectangular tow band structure exiting air jet 240 permits particles of solids to evenly distribute within the tow fiber structure. The fiber structure with evenly distributed solid particles can quickly be delivered to a subsequent process so that solid particle containment is achieved. Liquid addition from assembly 80 also enhances solids containment.

After the addition of solid substances by assembly 120, tow 14 is delivered to an optional speed delivery assembly 90 comprising, among other things, a driven roller 92 and a roller 94, either or both of which may have a rubber or metal surface for contact with tow 14. Driven roller 92 controls the overall operation of the process and the speed of the tow 14 as it is delivered to another process such as a diaper or absorbent composite forming machine. In general, driven roller 92 and driven roller 72 are operated at speeds such that the surface speed ratio (72/92) is from about 1.0:1.0 to about 3.0:1.0, preferably 1.8:1.0 to 2.2:1.0.

The linear speed of roll 92 is typically controlled by the line speed of a diaper or absorbent composite forming process to which the lofty rectangular tow structure is being fed.

In the preferred embodiment, tow 14 is delivered directly to a diaper or absorbent composite forming process without the use of delivery speed assembly 90. In this embodiment, the diaper or absorbent composite process acts as the delivery or takeaway speed control. The tow band structure with solids and applied liquids is nipped between rollers or wrapped around a driven single roller and pulled away from the air jet 240. Tissues or other webs can be introduced to encapsulate the fiber solids structure.

Additional optional static eliminating bars, elements 102 and 103, may be positioned between the air opening jet 240 and the liquids addition assembly 80, and after the air opening jet 240. Static eliminating bars 100, 101, 102, and 103 can facilitate controlling the processability of tow 14 by limiting static electricity and controlling the shape of the rectangular structure of tow 14. Additional static eliminating bars may be employed as required and are recommended when the moisture content in the environment is low. Such additional anti-static bars may not only be located after assemblies 60, 70 and 80, but also between assemblies 60 and 40, 40 and 130, and 120 and 90. Preferred embodiments have at least static eliminating bars 100, 101, and 102.

Figure 5:
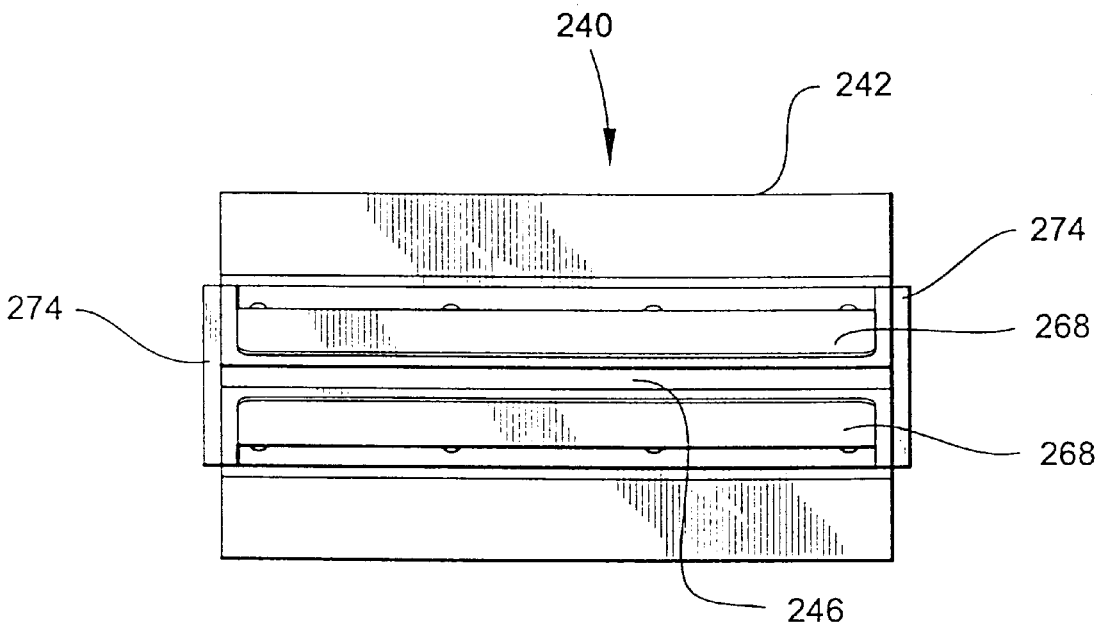
FIG. 5 is an end elevational view illustrating the outlet opening in the housing.
Figure 6:
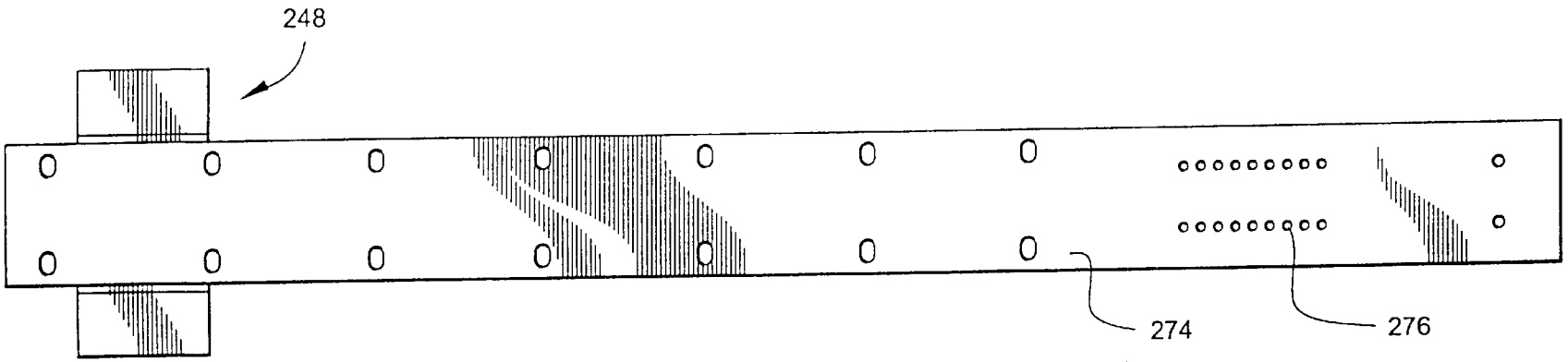
FIG. 6 is an elevational view of one of the side plates of the housing.
Figure 7:
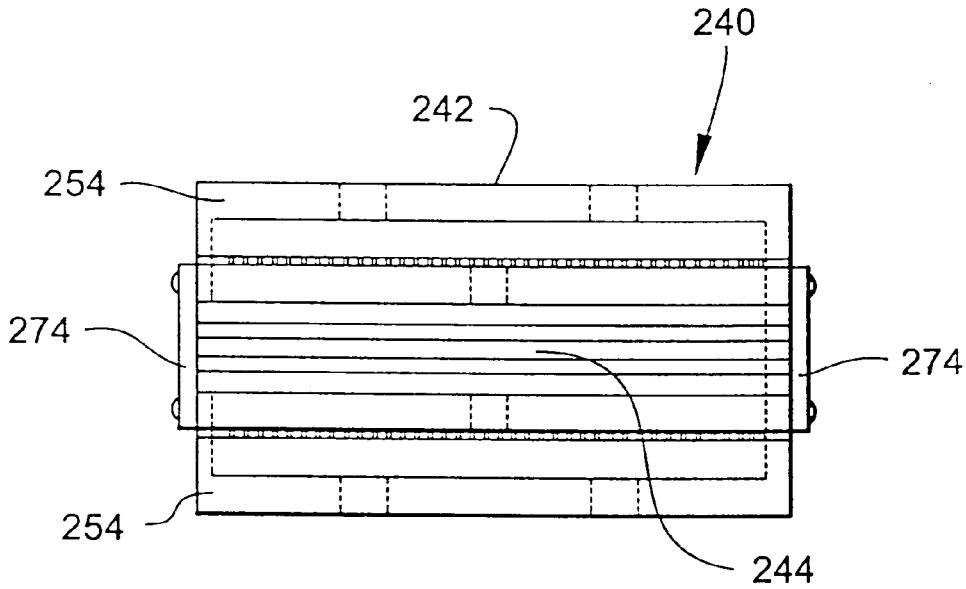
FIG. 7 is an end elevational view of the inlet opening of the housing.

The air opening jet 240 of the present invention includes a housing 242 that is formed, at one of its ends, with an inlet opening 244. As best seen in FIG. 7, the inlet opening 244 has a generally rectangular configuration that corresponds generally to the shape of the partially opened tow 14 which is received in the inlet opening 244 as described above. The housing 242 also includes an outlet opening 246 which, as best seen in FIG. 5, also has a rectangular configuration that corresponds to the desired shape of the tow leaving the air opening jet apparatus 240.

Figure 3:
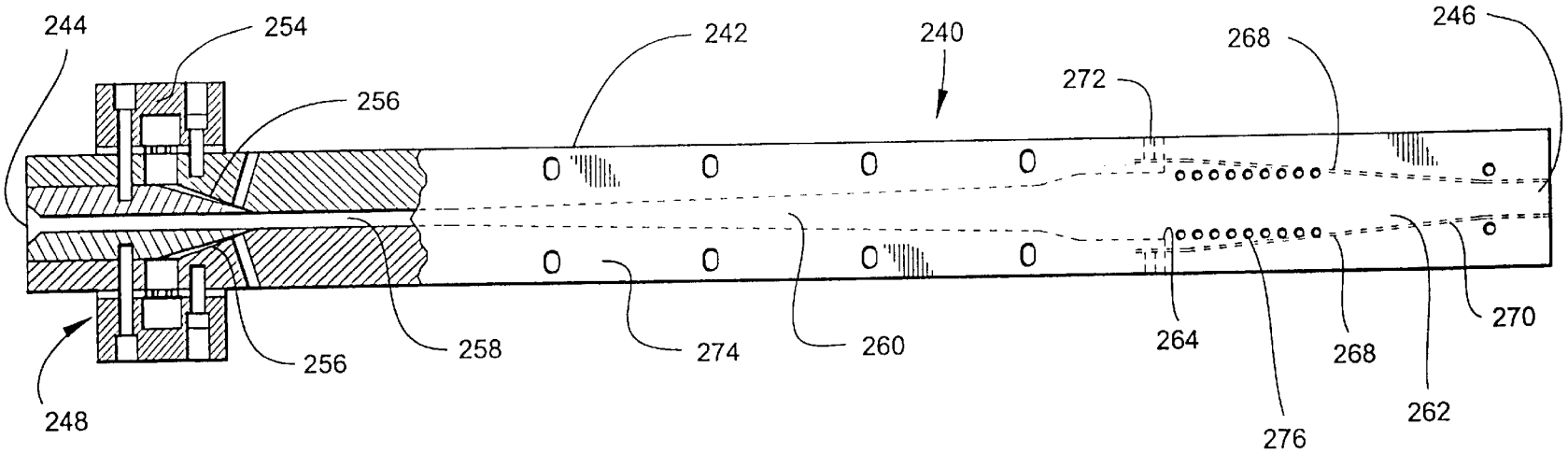
FIG. 3 is a side elevational view, partially in section, illustrating the air opening jet illustrated in FIG. 2.

An air jet, generally indicated by the reference numeral 248, is formed adjacent the inlet end of the housing 242, and it includes a source of compressed air 250 and a conventional control valve 252 for regulating the flow of compressed air from the compressed air source 250 to an air manifold, 254 through which the compressed air is delivered to jet orifices 256 which form a conventional jet of air for moving the tow 14 through a central passageway 258 in the housing 242 as will be explained in greater detail presently. As best seen in FIG. 3, the passageway 258 has a gradually increasing cross-sectional area in the direction of movement of the tow 14 so as to provide a forming chamber 260 downstream of the air jet 248, and this forming chamber 260 also preferably has a generally rectangular configuration that corresponds to the rectangular shape of the tow 14.

An accumulating chamber 262 is located adjacent the outlet end of the housing 242 and downstream of the forming chamber 260, and the accumulating chamber 262 has a vertical dimension which is greater than the outlet opening 264 of the forming chamber 260, and it also is preferably formed with a rectangular configuration that will permit the opened tow 14 passing into the accumulating chamber 262 from the forming chamber 260 to accumulate within the accumulating chamber 262 and ultimately be withdrawn from the housing 242 through the outlet opening 246 at different flow rates and in the preferred rectangular shape of the tow 14.

Figure 4:
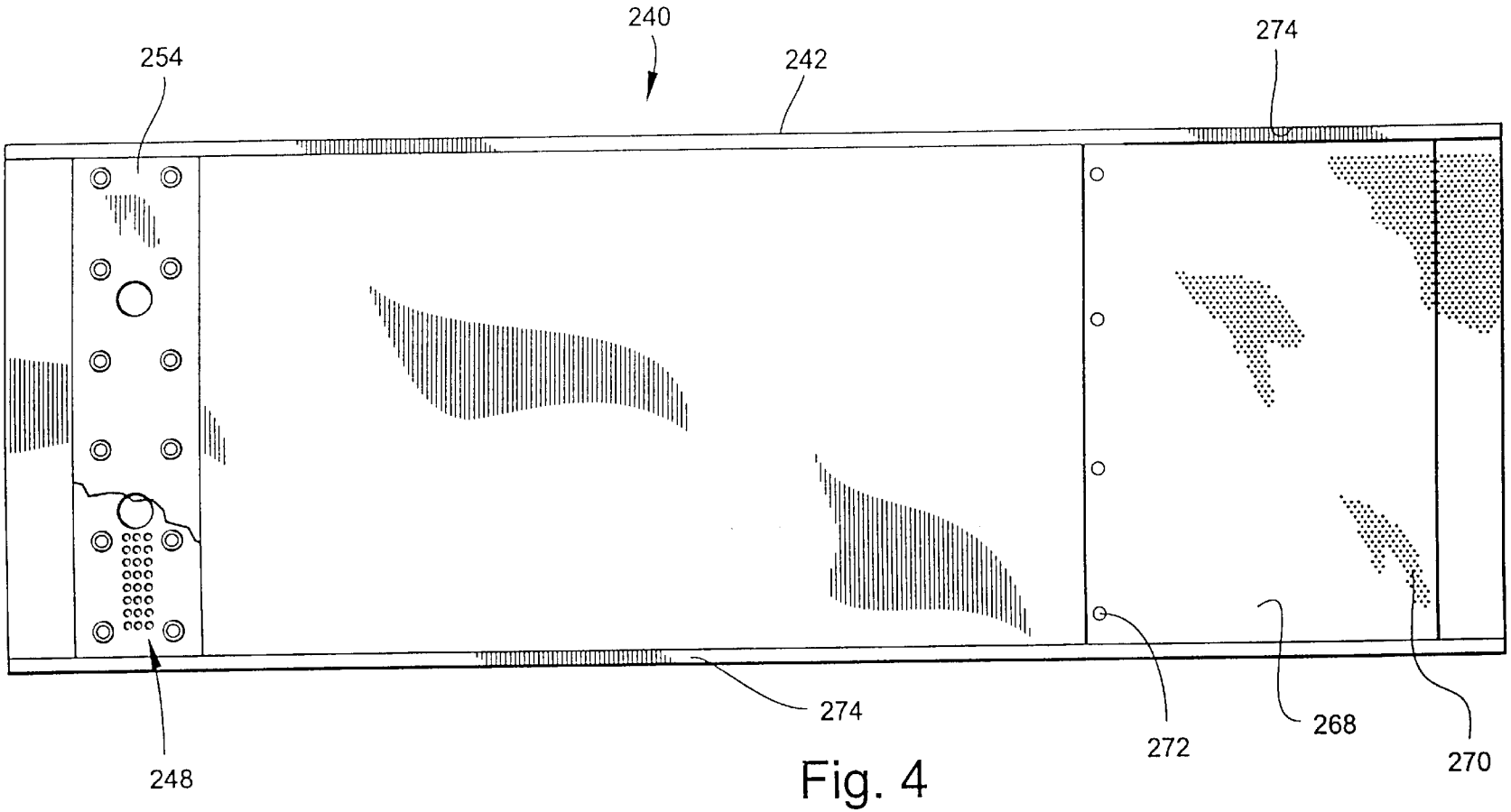
FIG. 4 is a plan view of the housing of the air opening jet illustrated in FIG. 2.

As best seen in FIGS. 3 and 4, a pair of plates 268, each having a large number of perforations 270 therein, are disposed in the accumulating chamber 262 and in the path of the tow 14 as it exits the forming chamber 260 and enters the accumulating chamber 262. The plates 268 are fixed in place within the accumulating chamber 262 by a plurality of bolts 272 that maintain the plates 268 in fixed positions within the accumulating chamber 262.

The housing 242 also includes a pair of side plates 274 which extend along both sides thereof (see FIG. 7) to enclose the sides of the accumulating chamber 262 and the forming chamber 260, and each of the side plates 274 is formed with a plurality of perforations 276 which are located generally at a position where the carrier air leaves the forming chamber 260 and enters the accumulating chamber 262, whereby some of the carrier air can be discharged through the perforations 276.

In operation of the air opening jet apparatus 240, compressed air from the compressed air source 250 flows to the air jet 248 at a flow rate controlled by the control valve 252, and the jet of air formed by the orifices 256 will move the tow 14 through the forming chamber 260. As the tow 14 is moved through the forming chamber 260 by the carrier air, the carrier air will partially open and expand the tow 14 so that it gradually increases in cross-sectional area in conformity with the gradually increasing cross-sectional area of the forming chamber 260. When the tow exits the forming chamber 260 and enters the accumulating chamber 262, it first opens even further to correspond to the vertical distance between the upstream ends of the perforated plates 268 (see FIG. 3), and the tow 14 engages the inner surfaces of the perforated plates 2 which are disposed in the path of the tow 14.

While some of the carrier air may be discharged through the perforations 276 in the side plates 274, a substantial portion of the carrier air moves the tow 14 through the spacing between the perforated plates 268 and passes outwardly through the perforations 270 in the plates 268. In so doing, the air passing outwardly through the perforations 270 urges the tow 14 into frictional engagement with the facing inner surfaces of the perforated plates 268, and this frictional engagement creates a braking action on the tow 14 which retards the movement of the tow 14 through the accumulating chamber 262 and causes the tow to density and accumulate in the accumulating chamber 262 at a density greater than it had in the forming chamber 260, after which the opened and now densified tow 14 exits the accumulating chamber 262 through the outlet opening 246 at different flow rates.

It is important that the tow 14 which exits through the outlet opening 246 has a desired and uniform density throughout the generally rectangular shape of the tow 14, and the present invention provides a unique and very desirable method of properly controlling the density of the exiting tow 14. More specifically, it will be apparent that the flow rate of the carrier air will determine the retarding or braking action applied to the tow 14 as it passes between the perforated plates 268. If the flow rate of the carrier air is increased, the carrier air passing outwardly through the perforations 270 in the plates 268 will urge the tow 14 into engagement with the plates 268 with a greater force, and will thereby increase the retarding or braking action that is applied to the tow 14. Conversely, if the flow rate of the carrier air is decreased, there will be a smaller braking action applied to the tow 14.

Therefore, virtually infinite regulation of the braking action is obtained in the present invention by the simple expedient of operating the control valve 252 to provide a flow of carrier air that will provide the desired braking action imposed on the tow 14, and thereby control the density of the tow 14 as it leaves the housing 242.

Although it will be appreciated that the actual flow rate of the carrier air will vary from application to application depending on a number of factors, it has been found in operation of a prototype of the present invention that an air pressure of about 40 psi provides a desirable density of the tow 14 consisting of 0.004 grams/cm$^3$ exiting through an outlet opening having a width of 20 centimeters and a height of 2.5 centimeters.

Figure 8:
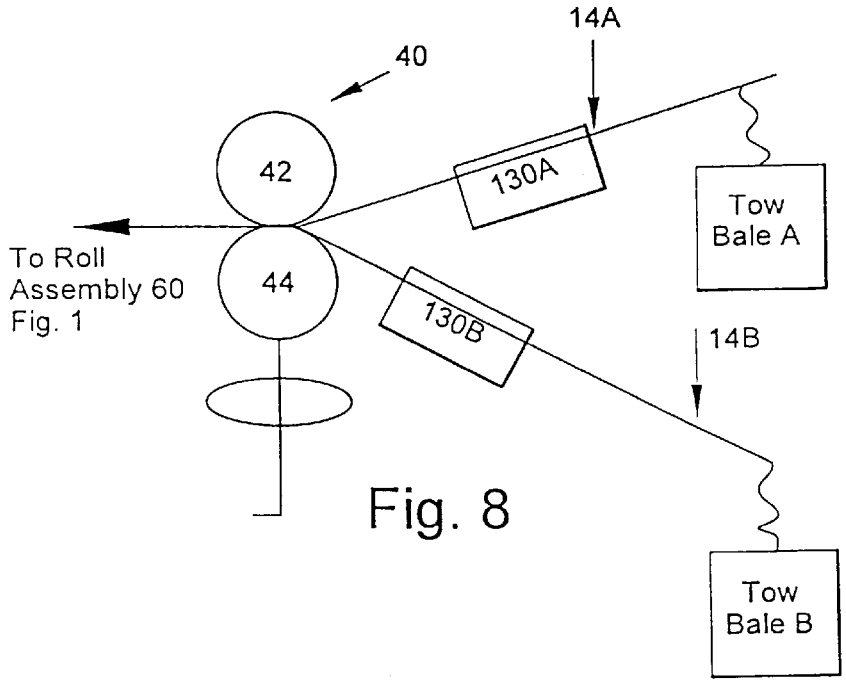
FIG. 8 is a diagrammatic illustration of an alternate tow opening system utilizing the air opening jet apparatus in accordance with the present invention.
Figure 12:
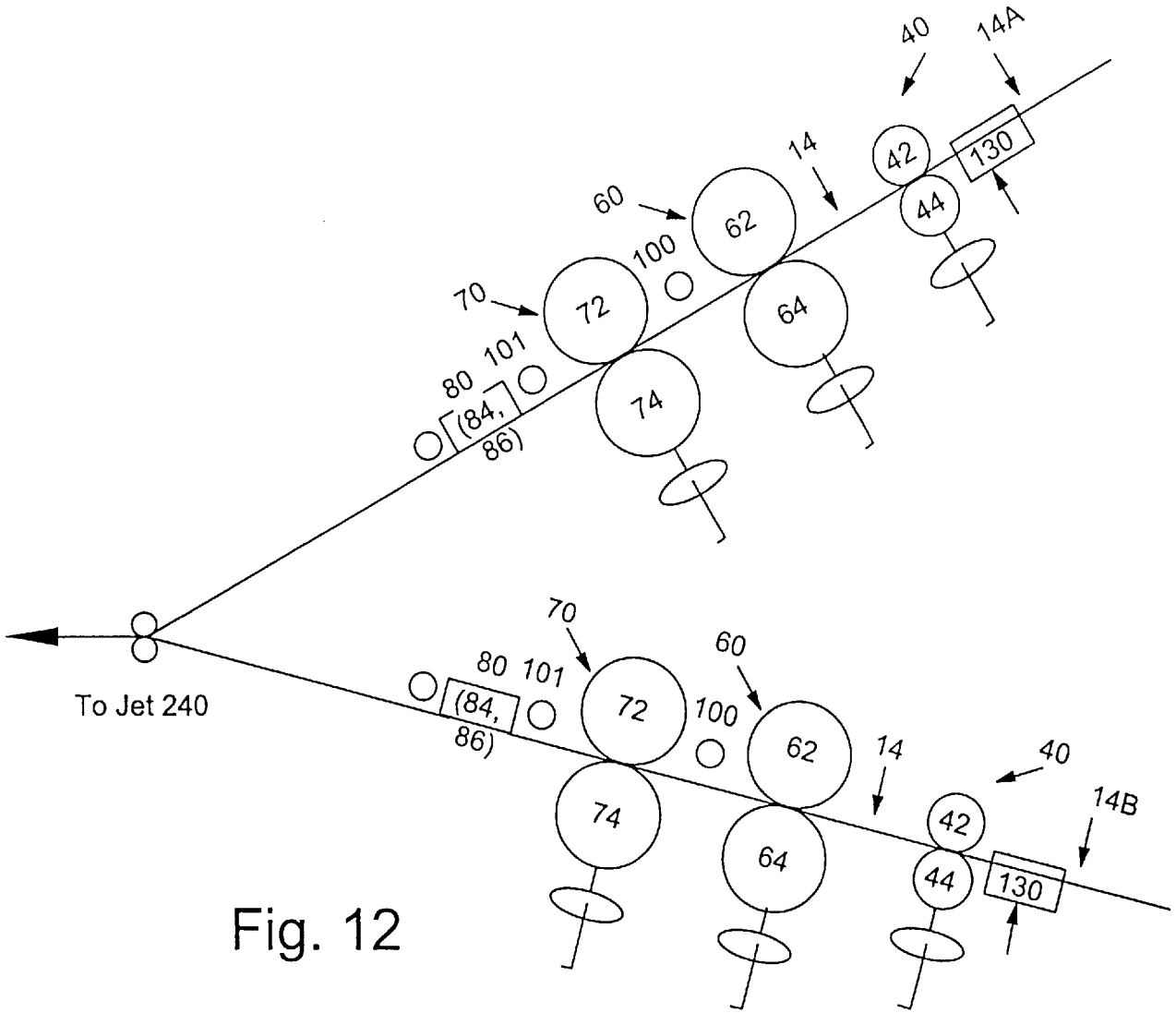
FIG. 12 is a diagrammatic illustration of still another alternate tow opening system utilizing an air opening jet apparatus in accordance with the present invention.
Figure 16:
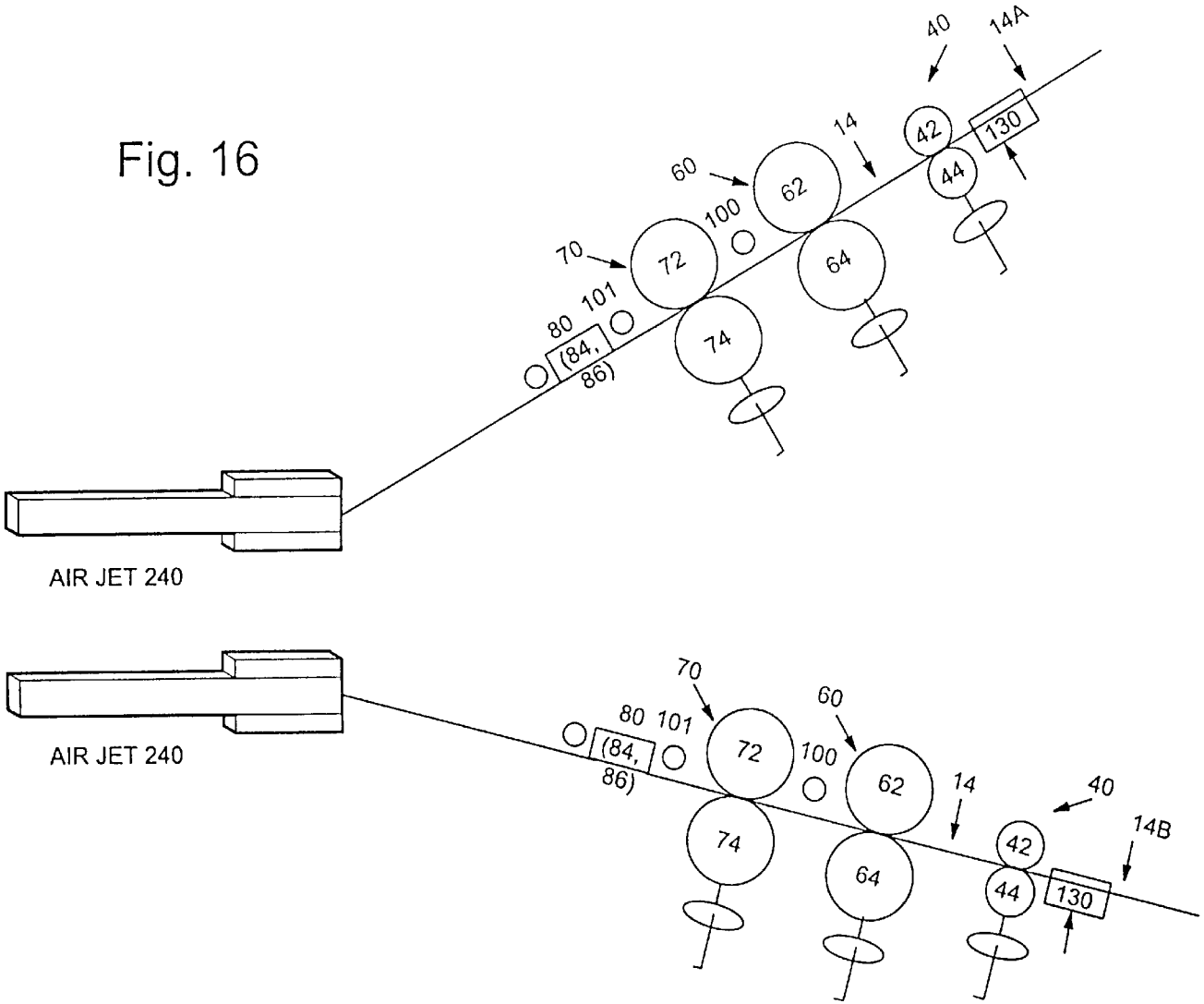
FIG. 16 is a diagrammatic illustration of still another alternate tow opening system utilizing an air opening jet in accordance with the present invention.

FIGS. 8, 12, and 16 illustrate diagrammatically three alternative tow opening systems which utilize the air opening jet apparatus 240 of the present invention in a unique manner. More specifically, FIG. 8 illustrates a system in which a plurality of tow bands are fed into the inlet of the air jet opening apparatus 240. In FIG. 8, where the individual components which are identical to the components described above in connection with FIG. 1 are identified by the same reference numerals, two tow bands 14A and 14B are illustrated, but it will be understood that more than two tow bands could be utilized, depending on the desired end product.

As best seen in FIG. 8, the two tow bands 14A and 14B are each fed from a tow bale and into a conventional banding jet 130A and 130B, respectively, which are described in greater detail herein. After the tow bands 14A and 14B are processed by the air banding jets 130A and 130B, both tow bands 14A and 14B are delivered to the nip of a pre-tension roller assembly 40 that consists of metal roller 42 and a rubber roller 44, all as described above in connection with FIG. 1. After the combined tow band leaves the pre-tension roller assembly 40, it is fed through the same series of components as that described in connection with FIG. 1.

Figure 9:
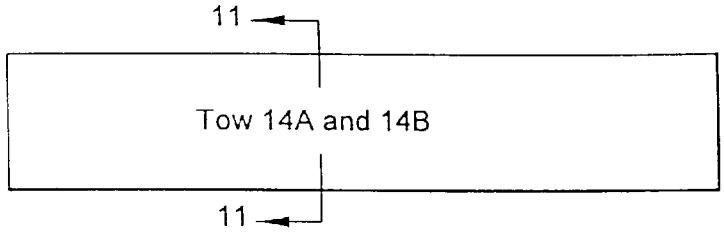
FIG. 9 is a diagrammatic illustration in transverse, i.e. widthwise, cross-section of a first embodiment of a composite multi-tow web product formed by the system illustrated in FIG. 8.

FIG. 9 schematically depicts in transverse cross-section the resultant end product exiting from the air opening jet 240 in the system of FIG. 8, wherein the air banding jets 130A and 130B are set up to deliver the individual tow bands 14A and 14B in identical widths and in precise widthwise overlying registration with respect to one another. In advance of the air opening jet 240, the pretension roller assembly 40 and the roller assemblies 60, 70 effectively produce a substantial degree of initial intermixing of the filaments of the tow bands 14A and 14B following which the air opening jet 240 effectively causes the individual filaments in the two tow bands 14A and 14B to become substantially completely intermixed with one another into a composite web wherein the individual filaments of the tow bands 14A and 14B are commingled with one another essentially throughout the entire widthwise extent and through essentially the entire thickness of the web, as schematically depicted in FIG. 9.

Figure 10:
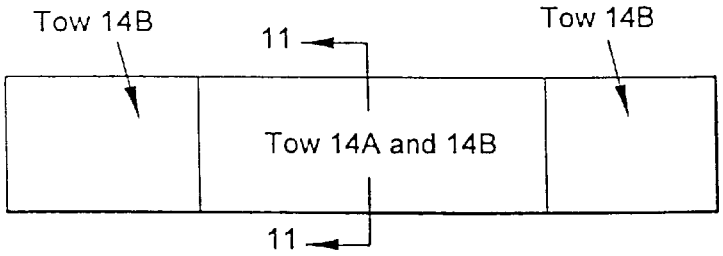
FIG. 10 is another diagrammatic illustration in transverse cross-section, similar to FIG. 9, of a second embodiment of a composite multi-tow web product formed by the system illustrated in FIG. 8.

However, in the system illustrated in FIG. 8, the band width of each individual tow band 14A and 14B can be individually controlled by the operation of the conventional air banding jets 130A and 130B to vary the width of the tow bands 14A and 14B which are simultaneously delivered to the air opening jet 240 to provide a unique product, one example of which is illustrated in FIG. 10. Thus, the tow bands 14A and 14B may, if desired, be initially fed from the tow bales through conventional guide components (not shown) that flatten and orient the tow bands 14A and 14B in a manner well known in the art, and when the tow bands 14A and 14B reach the air banding jets 130A and 130B the tow bands are spread in a direction perpendicular to the direction of movement of the tow bands to thereby open the two tow bands 14A and 14B within the banding jets 130A and 130B. Moreover, the widths of the tow bands 14A and 14B can be varied by the air banding jets 130A and 130B so that the ultimate product delivered from the air opening jet 240 has a particular desired composite tow structure. As one example of such a composite tow structure, FIG. 10 illustrates in transverse cross-section the end product exiting from the air opening jet 240 in the system of FIG. 8 set up such that the air banding jet 130A delivers a narrower tow band 14A centered in overlying relation with respect to a larger and wider tow band 14B delivered by the air banding jet 130B. In similar fashion as above-described, the roller assemblies 40, 60, 70 followed by the air opening jet 240 effectively causes the individual filaments of the tow bands 14A and 14B to become commingled into a composite web wherein the central lengthwise region of the web has the filaments of the two tow bands 14A and 14B commingled substantially throughout, but the outer edgewise regions of the composite web will be comprised substantially entirely of the filaments of the wider tow band 14B, as schematically represented in FIG. 10.

Figure 11:
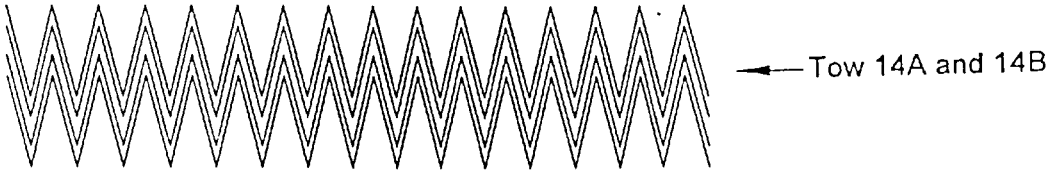
FIG. 11 is an exaggerated diagrammatic illustration in lengthwise cross-section taken along the lines 11—11 in FIGS. 9 and 10 illustrating the relationship of the filaments of the composite multi-tow web products of FIGS. 9 and 10.

FIG. 11 is a schematic depiction of a lengthwise cross-section taken through either of the composite tow webs of FIG. 9 or 10 along section lines 11—11 showing the crimped nature of the tow filaments and schematically illustrating the intimate commingling of the filaments of the tows 14A and 14B, characterized in that the respective filaments of the tows essentially cannot be distinguished from one another. Of course, as persons skilled in the art will recognize, many other variations of composite multi-tow web products may be produced as a result of the processing system of FIG. 8 as well as other possible alternative processing systems of the present invention, such as those of FIGS. 12 and 16 as will be explained in greater detail below.

Another alternate processing system using the unique air opening jet 240 is illustrated in FIG. 12, and, again, to the extent that the components illustrated in FIG. 12 are identical to those in FIG. 1, the same reference numerals are used and the details need not be described again here. In this system, the tow bands 14A and 14B are fed from the tow bales (as shown in FIG. 8) to the individual air banding jets 130 in the same manner as that described above in connection with FIG. 8. However, in the system illustrated in FIG. 12, the tow bands 14A and 14B are each processed individually through all of the components which act upon the single tow band 14 in FIG. 1, i.e., through separate respective pre-tension roller assemblies 40, and separate respective roller assemblies 60, 70, and separate respective liquid additive assemblies 80, and since the two tow bands 14A and 14B are individually processed by a variety of processing components as illustrated in FIG. 12, this system can be used to effectively control the width of the two tow bands 14A and 14B, and to control individually the delivery speed and bloom of each tow band 14A, 14B. Additionally, since a liquid additive is applied individually to the tow bands 14A and 14B by components 80, 84 and 86, which are described in connection with FIG. 1 above, different additives or no additives can be applied to either or both of the tow bands 14A and 14B to achieve separate effects for each tow component, such as varying the super absorbent polymer containment, the solids attachment, or the fluid distribution enhancement characteristics of the respective tow bands 14A and 14B. Alternatively or in addition, additives may also be applied to the resultant composite tow web downstream of the air opening jet 240.

In contrast to the system of FIG. 8, the use of separate respective pre-tension roller assemblies 40, roller assemblies 60, 70 and liquid additive assemblies 80 for the two respective tow bands 14A and 14B in the system of FIG. 12 prevents any intermixing of the tow bands 14A and 14B prior to delivery into the air opening jet 240. Hence, in the composite tow web exiting the air opening jet 240, the individual filaments of the two tow bands 14A and 14B are intermixed only via the action of the air opening jet 240 and, hence, to a lesser extent than in the composite web produced by the system of FIG. 8. More specifically, the composite tow web produced by the system of FIG. 12 essentially has three identifiably differing tow regions across the thickness of the composite web: a first region adjacent one outward face of the composite web comprised predominately of the air-opened deregistered filaments of the tow band 14A merging gradually into an intermediate region centrally across the thickness of the tow web comprised of opened and deregistered filaments of both tow bands 14A and 14B substantially commingled with respect to one another which merges gradually into a third region at the opposite outward face of the composite tow web comprised predominately of the opened deregistered filaments of the tow band 14B. These three regions are schematically depicted in transverse cross-section by the composite tow webs of FIGS. 13 and 14, FIG. 13 depicting an embodiment of the composite tow web produced by the system of FIG. 12 wherein the tows 14A and 14B are of the same width and overlie one another in widthwise registry and FIG. 14 illustrating an alternative embodiment of composite tow, similar to that of FIG. 10, wherein the tow 14A is of a narrower widthwise extent centered in overlying relation with respect to the wider tow 14B.

Figure 13:
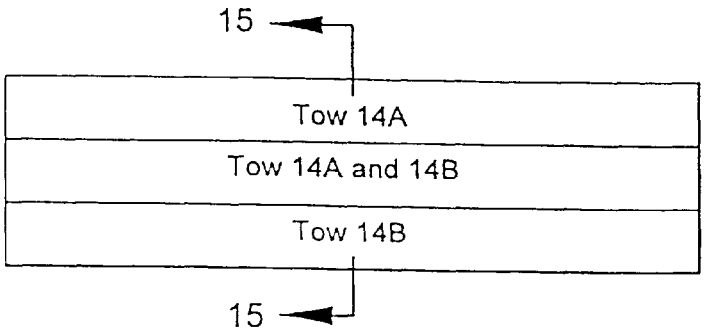
FIG. 13 is a diagrammatic illustration in transverse cross-section of a first embodiment of a composite multi-tow web product formed by the systems illustrated in FIG. 12.
Figure 14:
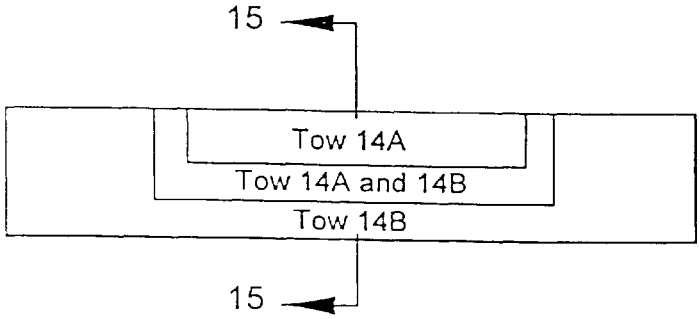
FIG. 14 is another diagrammatical illustration in transverse cross-section of a second embodiment of a composite multi-tow web product formed by the system of FIG. 12.
Figure 15:
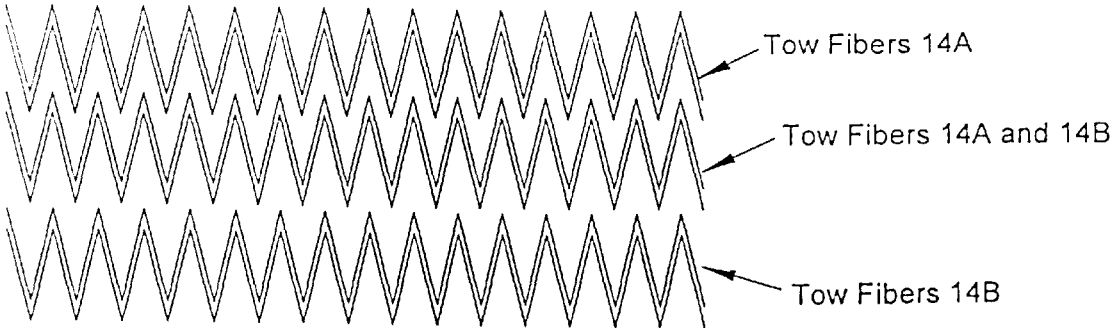
FIG. 15 is an exaggerated diagrammatic illustration in lengthwise cross-section taken along lines 15—15 in FIGS. 13 and 14 illustrating the relationship of the filaments in the composite multi-tow products of FIGS. 13 and 14.

FIG. 15 illustrates schematically the three regions of the composite tow web of FIGS. 13 and 14 in lengthwise cross-section, similar to that of FIG. 11 .In contrast to the composite tow web produced by the system of FIG. 8, the composite tow web space produced by the system of FIG. 12 has the respective filaments of the individual tow bands 14A, 14B substantially commingled with one another predominately only in the region of the interface between the tow bands 14A and 14B when delivered into the air opening jet 240.

It will be understood that the ability to utilize a plurality of individually controlled and/or processed tow bands in combination with the air opening jet 240 provides an opportunity for producing a wide variety of products that have a structure and composition which can be tailored to a particular function. For example, it is possible to create a composite tow web structure that is particularly well suited to serve as a component of an absorbent disposable device, such as a disposable diaper. A composite tow structure of an embodiment such as illustrated in FIG. 10 or 14 would be suitable for this particular application, and would consist of a tow band 14A having a higher denier units per filter (DPF), e.g., 6–8 DPF, and a total denier of between 12,000 to 20,000. Tow band 14A would be oriented in the middle of the composite structure as illustrated in FIG. 10 or 14 so that it would be in contact with, or closely adjacent to, the initial fluid insult zone of the absorbent disposable device, and the higher DPF in the tow band 14A will provide improved fluid acquisition because of its higher strength and resistance to collapse when hydrated. In a typical example, the banding jet 130A in FIG. 8, or the banding jet 130 applied to tow band 14A in FIG. 12, would restrict the width of tow band 14A to approximately 80 mm. If the system in FIG. 12 is utilized, the liquid applied to tow band 14A, via liquid application assembly 80, would be a surfactant that will enhance fluid management within the fluid acquisition structure. On the other hand, the tow band 14B would have a lower DPF, e.g., 2–3, with a total denier of between 30,000–40,000, and tow band 14B would be oriented on the bottom of the composite structure so that it would be the main core body of the absorbent disposable device. The lower DPF tow band structure would provide improved super absorbent polymer containment because of the higher density, larger fiber surface contact area and a larger number of individual fibers. Thus, for example, a 2.0 DPF/40,000 total denier tow band 14B would have approximately 20,000 separate fibers, whereas a 6.0 DPF/15,000 total denier tow band 14A would have only about 2,500 separate fibers. Preferably, the banding jet 130B would restrict the width of the tow band 14B to 150 mm, which would be the full inlet width of the air opening jet 240, so that the composite tow structure exiting the air opening jet 240 would have a configuration as diagrammatically shown in FIG. 10. Finally, if the system illustrated in FIG. 12 is utilized, the liquid applied to the tow band 14A, via assembly 80, would be preferably a bonding agent such as a plasticizer, water, or water-based adhesive to enhance the super absorbent polymer containment and/or solid attachment or containment within the structure of the tow band 14B.

It will be understood, of course, that the particular composite tow structures described above are only representative examples of a variety of composite tow structures that can be created utilizing the systems illustrated in FIGS. 8 and 12. For example, in addition to controlling the width of the tow bands 14A and 14B, if the system illustrated in FIG. 12 is utilized, it is also possible to separately control the delivery speed and/or bloom of each individual tow band 14A and 14B by controlling the speed of the roller assemblies 60 and 70, to thereby vary the characteristics of the tow bands 14A and 14B which are delivered to the air jet 240. Likewise, other types of filaments may be used to form the tow bands 14A and 14B. For example, it is contemplated that one of the tow bands may be formed of filaments which comprise a fusible bi-component fiber material which may be utilized to bind together the filaments of the tow bands 14A and 14B by subjecting the composite tow web to a subsequent heat treatment. Naturally, many other alternative embodiments will readily occur to persons skilled in the art.

It is further contemplated that the ability provided by the present invention to selectively combine and intermix differing tow bands into a composite tow web may enable the resultant tow web to have superior or enhanced features, characteristics and/or performance in comparison to opened tow webs made of a single tow band. In order to assess this possibility, experiments were conducted comparing a composite tow web made in accordance with the system of FIG. 8 described above and opened tow webs made of a single tow band utilizing the system of FIG. 1. The results of such experiments are compiled in the charts of FIGS. 19 and 20. Each web was identically treated to apply thereto a layer of a super absorbent polymer (SAP), appropriate porous and non-porous glue layers, and outer coverings of tissue, to produce from each web an absorbent device such as utilized in a disposable diaper as described above. Two sample devices were made of differing composite tow webs produced by the system of FIG. 8 and three sample devices were made of single tow webs produced by the system of FIG. 1, and the devices were then tested to determined their liquid acquisition and absorption capabilities. The differing physical characteristics of the sample devices are compiled for comparative purposes in the chart of FIG. 19, while the results of the testing of such devices are compiled in the chart of FIG. 20. The sample devices made with composite tows utilizing the system of FIG. 8 are identified as Samples 6-0601 and 7-0601, while the sample devices made of a single tow utilizing the system of FIG. 1 are identified as Samples 2-0601, 3-0601, and 4-0601.

As will be seen, the sample devices made with the composite tow webs achieved superior acquisition and absorption results in comparison to the devices made with the single tow webs, even as to the single tow webs having the same average denier per filament as the composite tow webs. It is reasonable to conclude from these experiments that the composite tow webs provide for better containment of the super absorbent polymer than webs made of a single tow which, in turn, indicates that the tow structure has a higher degree of stability.

Another unique system utilizing the air opening jet 240 of the present invention is illustrated in FIG. 16 where, again, like reference numerals are used to identify the same components of the system as those described above in conjunction with FIG. 1. In this system, each of the tow-bands 14A, 14B are passed separately through a series of processing steps, and then fed to the intake of a separate air opening jet 240. More specifically as illustrated in FIG. 16, each two band 14A and 14B are passed individually through a banding jet 130, then through roller assemblies 40, 60 and 70 as described above, and then through the liquid addition assembly 80, after which each tow band is fed to the intake of a separate air opening jet 240.

Figure 17:
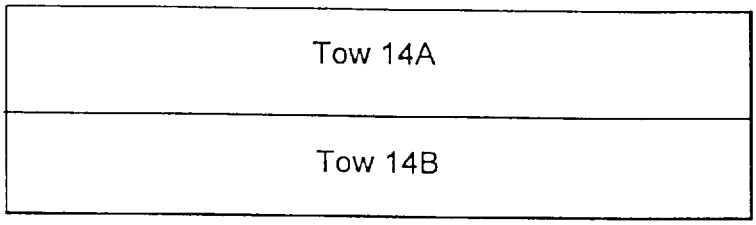
FIG. 17 is a diagrammatic illustration in transverse cross-section of a typical composite multi-tow web product formed by the system illustrated in FIG. 16.
Figure 18:
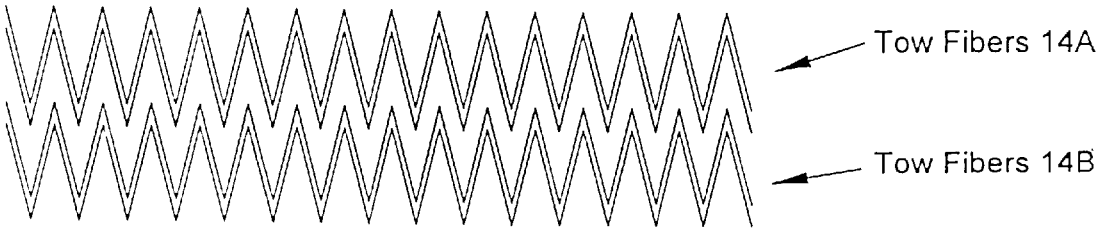
FIG. 18 is an exaggerated diagrammatic illustration in lengthwise cross-section taken along the line 18—18 of FIG. 17 illustrating the general relationship of the fibers in the multi-tow product of FIG. 17.

The tow bands exiting the air opening jets 240 are then combined and jointly delivered to the same components that are downstream of the air opening jet 240 as illustrated in FIG. 1, and when the combined tow bands are moved through the speed delivery roller assembly 90, a composite multi-tow web is created as diagrammatically illustrated in FIGS. 17 and 18.

Since the tow bands 14A, 14B are individually opened and processed in a separate air opening jet 240 and then combined together, the tow bands 14A, 14B, have a generally laminated layered relationship, as is depicted schematically in FIGS. 17 and 18, with very little entanglement of fibers of the two tow bands, 14A, 14B, as compared with the multi-tow webs illustrated in FIGS. 9, 10, 13 and 14.

Another advantage of the multi-tow webs formed by the system in FIG. 16 is that the laminated construction of the web lends itself to different types of specialty processing. For example, each layer in the product can be provided with separate and individualized finishes at the liquid additive stations 80, and, if desired, one or both of the liquid additive stations 80, or an additional processing station downstream of air opening jets 240, may insert a desired material (e.g. a super-absorbent polymer) between the layers formed by the tow bands 14A, 14B.

It will, therefore, be readily understood by those persons skilled in the art that the present invention is susceptible of broad utility and application. Many embodiments and adaptations of the present invention other than those herein described, as well as many variations, modifications and equivalent arrangements, will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. A system for opening a multi-tow band and forming it into a predetermined shape suitable for use as an absorbent structure for personal care products, said system comprising:

(a) a first arrangement for receiving a first tow from a tow bale having a predetermined denier units per filament, spreading the filaments in said first tow into a first tow band, and having an exit end for discharging said first tow band therefrom with a predetermined width;

(b) a second arrangement for receiving a second tow from a tow bale having a predetermined denier units per filament which is different from the predetermined denier of said first tow, spreading the filaments in said second tow into a second tow band, and having an exit end for discharging said second tow band therefrom with a predetermined width;

(c) an air jet opening apparatus that includes:

(i) a housing;

(ii) an inlet for simultaneously receiving said first and second tow bands as a multi-tow band with said first and second tow bands having been selectively combined and with one of said bands being disposed on top of the other band;

(iii) an air jet for opening and controllably intermixing said multi-tow band; and (iv) an exit end for discharging said opened multi-tow band.

2. A system for forming a multi-tow band as defined in claim 1, wherein the width of said exit end of one of said first or second arrangement is smaller than the other, whereby said multi-tow band discharged from said exit end of said air jet opening apparatus has one tow band that is larger in width than the other.

3. A system for forming a multi-tow band as defined in claim 2, wherein said tow band having the larger width has a different denier per filament than the denier per filament of the other tow band.

4. A system for forming a multi-tow band as defined in claim 2, wherein said tow band having the larger width has a denier per filament that is less than the denier per filament of the other tow band.

5. A system for forming a multi-tow band as defined in claim 2, wherein the system includes a surfactant applicator located upstream of the inlet of said air opening jet for individually applying a surfactant to one or both of said tow bands.

6. A system for forming a multi-tow band as defined in claim 5, wherein said surfactant is applied only to said tow band having the smaller width.

7. A system for forming a multi-tow band as defined in claim 2, wherein the system includes a bonding agent applicator located upstream of the inlet of said air opening jet for applying a bonding agent to one or both of said tow bands.

8. A system for forming a multi-tow band as defined in claim 7, wherein said bonding agent is applied to said tow band having the larger width.

9. A system for forming a multi-tow band as defined in claim 1, wherein each of said first and second arrangements comprises a tow banding jet for receiving the respective first or second tow and spreading the tow, and at least one pair of delivery rolls disposed between said first and second banding jets, respectively, and said air opening jet apparatus, and wherein the speed at which said first and second tow bands are delivered to said air jet opening apparatus can be individually controlled.

10. A system for forming a multi-tow band as defined in claim 1, wherein said first and second arrangements can be individually controlled to vary the bloom of said first and second tow bands.

11. A system for opening a multi-tow band and forming it into a predetermined shape suitable for use as an absorbent structure for personal care products, said system comprising:

(a) a first arrangement for receiving a first tow from a tow bale having a predetermined denier units per filament, spreading the filaments in said first tow into a first tow band, and having an exit end for discharging said first tow band therefrom with a predetermined width;

(b) a second arrangement for receiving a second tow from a tow bale having a predetermined denier units per filament which is different from the predetermined denier of said first tow, spreading the filaments in said second tow into a second tow band, and having an exit end for discharging said second tow band therefrom with a predetermined width; and (c) an air jet apparatus which includes (i) a housing having an inlet opening for simultaneously receiving said first and second tows and having a configuration corresponding generally to the shape of said first and second tows, and having an outlet opening through which said first and second tows exit said housing as a multi-layered tow having a configuration corresponding generally to said predetermined shape;

(ii) an air jet formed within the housing adjacent said inlet opening thereof to create a venturi which moves the first and second tows through the air opening jet apparatus and which also further opens the first and second tows;

(iii) a source of compressed air communicating with said air jet to provide carrier air for moving said first and second tows through said jet apparatus;

(iv) a forming chamber within the housing and downstream of the air jet that includes a gradually increasing cross-sectional area in the direction of flow of the first and second tows that corresponds to said predetermined shape, said air jet being disposed within said housing to cause said first and second tows to be fully opened and to substantially fill said forming chamber as they move therethrough;

(v) an accumulating chamber located within said housing downstream of said forming chamber that is constructed and arranged to permit said opened first and second tows to accumulate within the accumulating chamber and be withdrawn from said housing at different flow rates through said housing outlet opening in said predetermined shape, said accumulating chamber including at least one perforated plate disposed in the path of said first and second tows and said carrier air moving therethrough to cause said first and second tows to engage said perforated plate and to cause at least some of said carrier air to pass through said perforated plate; and (vi) a control valve for maintaining the flow of said carrier air at a level that will cause at least said portion of said carrier air to pass through said perforated plate and urge said first and second tows into frictional engagement with said perforated plate with sufficient force to retard the movement of the first and second tows through said accumulating chamber and cause said first and second tows to accumulate in said accumulating chamber.

12. A method of opening a multi-tow band and forming it into a predetermined shape suitable for use as an absorbent structure for personal care products, said method comprising the steps of:

(a) moving a first tow from a tow bale having a predetermined denier units per filament through a first arrangement to spread the filaments in said first tow into a first tow band, and discharging said first tow band therefrom with a predetermined width;

(b) moving a second tow from a tow bale having a predetermined denier units per filament which is different from the predetermined denier of said first tow through a second arrangement for spreading the filaments in said second tow into a second tow band, and discharging said second tow band therefrom with a predetermined width; and (c) selectively combining said first and second tow bands into a double-layered tow band at an inlet of an air jet opening apparatus, and passing said double-layered tow band through said air jet opening apparatus for opening and controllably intermixing said double-layered tow band and discharging said double-layered tow band.

13. A method of opening a multi-tow band and forming it into a predetermined shape as defined in claim 12, wherein the width of the tow band discharged from one of said first or second arrangements is smaller than the other, whereby said multi-tow band discharged from an exit end of said air jet opening apparatus has one tow band layer that is larger than the other.

14. A method of opening a multi-tow band and forming it into a predetermined shape as defined in claim 13, wherein said tow band having the larger width has a denier per filament that is less than the denier per filament of the other tow band.

15. A method of opening a multi-tow band and forming it into a predetermined shape as defined in claim 13, wherein a surfactant is applied to said tow band having a smaller width downstream of said air jet opening apparatus.

16. A method of opening a multi-tow band and forming it into a predetermined shape as defined in claim 13, wherein a bonding agent is applied to said tow band having the larger width downstream of said air jet opening apparatus.

17. A method of opening a multi-tow band and forming it into a predetermined shape suitable for use as an absorbent structure for personal care products, said method comprising the steps of:

(a) moving a first tow from a tow bale having a predetermined denier units per filament through a first arrangement to spread the filaments in said first tow into a first tow band, and discharging said first tow band therefrom with a predetermined width;

(b) moving a second tow from a tow bale having a predetermined denier units per filament which is different from the predetermined denier of said first tow, spreading the filaments in said second tow into a second tow band, and discharging said second tow band therefrom with a predetermined width;

(c) creating a jet of carrier air for moving the first and second tow bands through a housing from an inlet opening to an outlet opening;

(d) moving said first and second tow bands through a forming chamber within said housing having a gradually increasing cross-sectional area in the direction of flow of the first and second tow bands to partially open the first and second tow bands;

(e) moving the first and second tow bands into an accumulating chamber downstream of said forming chamber while causing said first and second tow bands to engage at least one perforated plate positioned in the path of said first and second tow bands and causing at least a portion of said carrier air to flow outwardly through said perforated plate; and (f) regulating the flow of said carrier air to cause the carrier air to urge the first and second tow bands into frictional engagement with said perforated plate with sufficient force to retard the movement of the first and second tow bands through the accumulating chamber and cause the first and second tow bands to accumulate within said accumulating chamber at a greater density than it has in said forming chamber.

18. A system for opening a multi-tow band and forming it into a predetermined shape suitable for use as an absorbent structure for personal care products, said system comprising:

(a) a first arrangement for receiving a first tow from a tow bale having a predetermined denier units per filament, spreading the filaments in said first tow into a first tow band, and having an exit end for discharging said first tow band therefrom with a predetermined width;

(b) a second arrangement for receiving a second tow from a tow bale having a predetermined denier units per filament which is different from the predetermined denier of said first tow, spreading the filaments in said second tow into a second tow band, and having an exit end for discharging said second tow band therefrom with a predetermined width;

(c) a first air jet opening apparatus that includes:
  (i) a housing;
  (ii) an inlet for receiving said first tow band delivered from the exit end of a first banding jet;
  (iii) an air jet for opening said first tow band; and
  (iv) an exit end for discharging said opened first band;

(d) a second air jet opening apparatus that includes:
  (i) a housing;
  (ii) an inlet for receiving said second tow band delivered from the exit end of a second banding jet;
  (iii) an air jet for opening said second tow band; and
  (iv) an exit end for discharging said opened second tow band; and (e) an arrangement downstream of said first and second air jet opening apparatus disposed to receive said tow bands discharged therefrom and to selectively combine and controllably intermix said tow bands into a multi-tow band.

19. A system for forming a multi-tow band as defined in claim 18, wherein the width of said exit end of one of said first or second arrangements is smaller than the other, whereby said multi-tow band formed at said exit ends of said first and second air jet opening apparatus has one tow band that is larger in width than the other.

20. A system for forming a multi-tow band as defined in claim 19, wherein said tow band having the larger width has a denier per filament that is less than the denier per filament of the other tow band.

21. A system for forming a multi-tow band as defined in claim 19, wherein the system includes a surfactant applicator located upstream of the inlet of one or both of said first and second air opening jets for individually applying a surfactant to one or both of said tow bands.

22. A system for forming a multi-tow band as defined in claim 21, wherein said surfactant is applied only to said tow band having the smaller width.

23. A system for forming a multi-tow band as defined in claim 19, wherein the system includes a bonding agent applicator located upstream of the inlet of one or both of said first and second air opening jets for applying a bonding agent to one or both of said tow bands.

24. A system for forming a multi-tow band as defined in claim 23, wherein said bonding agent is applied to said tow band having the larger width.

25. A system for forming a multi-tow band as defined in claim 18, wherein said first and second arrangements can be individually controlled to vary the bloom of said first and second tow bands.

26. A method of opening a multi-tow band and forming it into a predetermined shape suitable for use as an absorbent structure for personal care products, said method comprising the steps of:

(a) moving a first tow from a tow bale having a predetermined denier units per filament through a first arrangement to spread the filaments in said first tow into a first tow band, and discharging said first tow band therefrom with a predetermined width;

(b) moving a second tow from a tow bale having a predetermined denier units per filament which is different from the predetermined denier of said first tow through a second arrangement and spreading the filaments in said second tow into a second tow band, and discharging said second tow band therefrom with a predetermined width;

(c) moving said first tow band discharged from said first arrangement to a first air opening jet for opening and blooming said first tow band, and discharging said first tow band therefrom;

(d) moving said second tow band discharged from said second arrangement to a second air opening jet for opening and blooming said second tow band, and discharging said second tow band therefrom;

(e) selectively combining and controllably intermixing said first and second tow bands discharged from said first and second air opening jets to form a composite multi-tow band.

27. A method of opening a multi-tow band and forming it into a predetermined shape as defined in claim 26, wherein the width of the tow band discharged from one of said first or second arrangements is smaller than the other, whereby said multi-tow band has one tow band layer that is larger than the other.

28. A method of opening a multi-tow band and forming it into a predetermined shape as defined in claim 27, wherein said tow band having the larger width has a denier per filament that is less than the denier per filament of the other tow band.

29. A method of opening a multi-tow band and forming it into a predetermined shape as defined in claim 27, wherein a surfactant is applied to said tow band having a smaller width.

30. A product formed by the method defined in claim 12.

31. A product formed by the method defined in claim 17.

32. A product formed by the method defined in claim 26.

* * * * *

UNITED STATES PATENT AND TRADEMARK OFFICE

CERTIFICATE OF CORRECTION

PATENT NO. : 6,543,106 B1
DATED : April 8, 2003
INVENTOR(S) : Ames et al.

It is certified that error appears in the above-identified patent and that said Letters Patent is hereby corrected as shown below:

Column 9,
Line 11, please change the word “density” to -- densify --

Column 10,
Line 9, please add a hyphen to the word “pretension” to read -- pre-tension --.

Signed and Sealed this

Twelfth Day of August, 2003

JAMES E. ROGAN
*Director of the United States Patent and Trademark Office*